US008186129B2

(12) United States Patent
Noirot et al.

(10) Patent No.: US 8,186,129 B2
(45) Date of Patent: May 29, 2012

(54) DUAL FUNCTION PACKING BRACKETS FOR TAPERED ARCHITECTURAL COLUMNS

(75) Inventors: Nicholas N. Noirot, Fairview, PA (US); Joseph D. Leone, Lake City, PA (US)

(73) Assignee: CW Ohio, Inc., Conneaut, OH (US)

( * ) Notice: Subject to any disclaimer, the term of this patent is extended or adjusted under 35 U.S.C. 154(b) by 95 days.

(21) Appl. No.: 12/784,573

(22) Filed: May 21, 2010

(65) Prior Publication Data

US 2010/0300034 A1 Dec. 2, 2010

Related U.S. Application Data

(60) Provisional application No. 61/182,249, filed on May 29, 2009.

(51) Int. Cl.
*E04B 1/00* (2006.01)

(52) U.S. Cl. ..... 52/745.17; 52/301; 52/835; 52/651.01; 493/89; 248/230.1

(58) Field of Classification Search ..... 52/300, 52/301, 698, 704, 660, 663, 220.3, 93.1, 52/651.01, 651.07, 831, 745.17, 745.18, 52/FOR. 156, 835; 493/89, 111; 248/359, 248/230.1

See application file for complete search history.

(56) References Cited

U.S. PATENT DOCUMENTS

| | | | | |
|---|---|---|---|---|
| 614,729 | A * | 11/1898 | Lally | 52/301 |
| 1,547,175 | A * | 7/1925 | Lally | 52/301 |
| 2,897,929 | A * | 8/1959 | Lindman | 52/651.07 |
| 3,421,269 | A * | 1/1969 | Medow | 52/86 |
| 4,641,467 | A * | 2/1987 | Dupuis, Jr. | 52/297 |
| 4,998,619 | A * | 3/1991 | Sowa et al. | 206/392 |
| 5,481,846 | A * | 1/1996 | Macchietto | 52/831 |
| 6,305,670 | B1 * | 10/2001 | Ward et al. | 256/59 |
| 6,722,637 | B2 * | 4/2004 | Burkart et al. | 256/1 |
| 7,281,356 | B2 * | 10/2007 | Sanftleben et al. | 52/220.8 |
| 7,992,362 | B2 * | 8/2011 | Petta | 52/848 |
| 8,001,737 | B1 * | 8/2011 | Price | 52/220.8 |
| 2008/0184641 | A1 * | 8/2008 | Hendricks | 52/301 |

* cited by examiner

*Primary Examiner* — William Gilbert
*Assistant Examiner* — Gisele Ford
(74) *Attorney, Agent, or Firm* — Renner, Otto, Boisselle & Sklar, LLP

(57) ABSTRACT

Top and bottom packing brackets for supporting respective smaller top and larger bottom ends of a tapered architectural column during shipment and storage. Each of the packing brackets includes a ring portion and a surrounding frame portion joined together by webbing extending therebetween. The ring portion of the respective top and bottom packing brackets are sized to closely receive the smaller top and larger bottom ends of the columns.

17 Claims, 10 Drawing Sheets

DUAL FUNCTION PACKING BRACKETS FOR TAPERED ARCHITECTURAL COLUMNS

CROSS-REFERENCE TO RELATED APPLICATIONS

This application claims the benefit of U.S. Provisional Application Ser. No. 61/182,249, filed May 29, 2009, the entire disclosure of which is incorporated herein by reference.

FIELD OF THE INVENTION

This invention relates to packing brackets that can be used both to support a tapered architectural column during shipment and storage and to locate the column relative to a ceiling and/or floor support structure during installation.

BACKGROUND OF THE INVENTION

Architectural columns prefabricated, for example, out of fiber reinforced polymer composites are commonly used to add style and elegance to a house or other building structures including porches, balconies, pool enclosures, decks, gazebos, courtyards and patios or the like. Such columns may also be tapered to make them architecturally correct, may be made in a wide range of designs, sizes and shapes including round or square, and may be used for either interior or exterior applications. Capitals and bases of different designs and styles may also be prefabricated out of the same or similar materials as the architectural columns for use with the columns to add elegance and accents to the columns.

Typically these columns are shipped and stored in cardboard type cartons. If the columns are tapered, some type of packing must be used to support the smaller ends of the columns inside the cartons. Otherwise, the cartons can't be stacked on top of one another, since the stacking load would crush the ends of the cartons housing the smaller ends of the columns, making them unstable for stacking. Heretofore cardboard and foam fillers were commonly used as the packing material.

SUMMARY OF THE INVENTION

The present invention relates to packing brackets that can be used to support tapered architectural columns during shipment and/or storage, and can also be used for locating the columns in place during installation.

In accordance with one aspect of the invention, the packing brackets include a ring portion sized to closely receive an end of the columns and a frame portion surrounding the ring portion.

In accordance with another aspect of the invention, the ring portion and surrounding frame portion of the packing brackets are joined together by webbing extending therebetween.

In accordance with another aspect of the invention, mounting holes may be provided in the webbing for receiving fasteners for securing the packing brackets at any desired location along a ceiling or floor support structure for use in locating one or both ends of the columns in place.

In accordance with another aspect of the invention, a plurality of slots may be provided in the end of the ring portion facing downwardly when the packing bracket is attached to the ceiling or roof support structure for receiving spring retention members if provided on ornamental capitals for frictionally retaining the capitals on the columns when placed over the smaller upper end of the columns and the capitals are raised upwardly substantially to cover the packing bracket.

These and other advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

The present invention may be more readily understood by reference to the accompanying drawings in which.

DETAILED DESCRIPTION OF THE INVENTION

Figure 1:
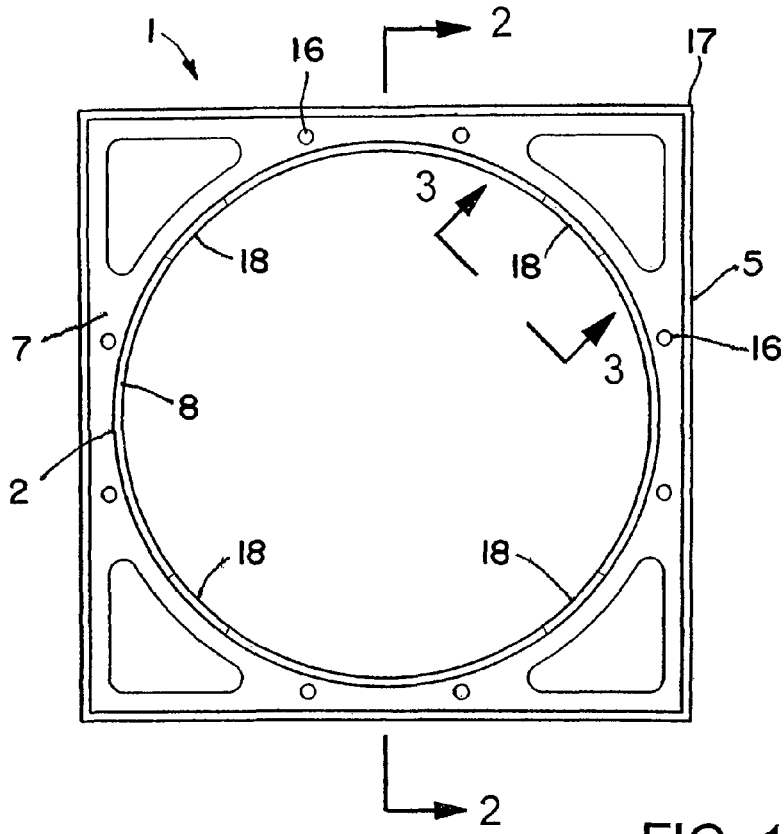
FIG. 1 is a schematic end view of one form of packing bracket in accordance with the present invention.

Referring now more particularly to the drawings and initially to FIGS. 1-5, there is shown one form of packing bracket 1 in accordance with the present invention, which may be used both to support the smaller end of a tapered architectural column within a shipping carton, and to locate the smaller end of the column in place along a ceiling or roof support structure after the column has been removed from the carton as described hereafter. The packing bracket may be made out of any suitable plastic material including for example recycled PVC.

Packing bracket 1 includes a ring portion 2 that is sized to closely receive the smaller top end 3 of a tapered architectural column 4 and a substantially square shaped frame portion 5 surrounding the ring portion that is sized to closely fit inside a cardboard shipping carton 6 (see FIG. 4) for supporting the smaller top end of the column inside the carton during storage and/or shipment. Ring portion 2 and surrounding frame portion 5 are joined together by webbing 7 extending therebetween.

Figure 5:
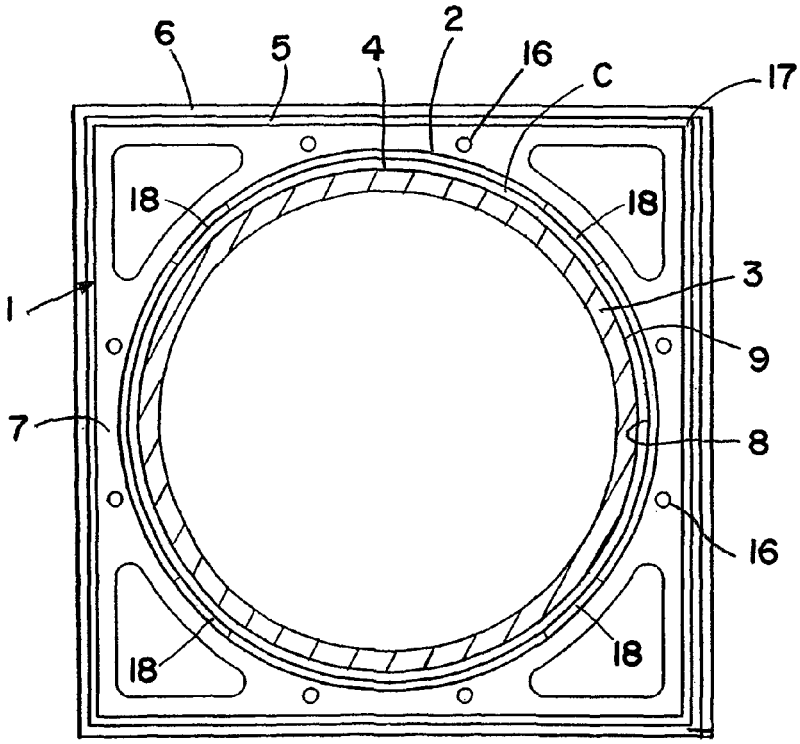
FIG. 5 is an enlarged transverse section through the carton and column of FIG. 4, taken along the plane of the line 5-5 thereof.

Preferably there is a clearance C of approximately 1/16 inch between the ring opening 8 and exterior wall 9 of the smaller top end 3 of the column (see FIG. 5). This makes it relatively easy to insert the smaller top end of the column into the ring opening prior to placing the column and associated packing into a shipping carton, and if the packing bracket is later used to locate the smaller top end of the column in place along a ceiling or roof support structure as described hereafter.

The tapered columns may be of different sizes, for example, 8 inch, 10 inch and 12 inch, which would require different size packings. By way of example, an 8 inch tapered round column has an outside diameter of approximately 8 inches at the bottom and approximately 6½ inches at the top. However, because the columns are molded, these dimensions will vary somewhat due to varying amounts of shrinkage. If the smaller end of a particular column doesn't properly fit inside the ring portion 2 of an appropriately sized packing bracket 1, the column may not be of a proper size for its intended application. Moreover, while the columns are shown in the drawings as being round, they may also be square, in which event the packing bracket ring opening would also have to be square.

Figure 2:
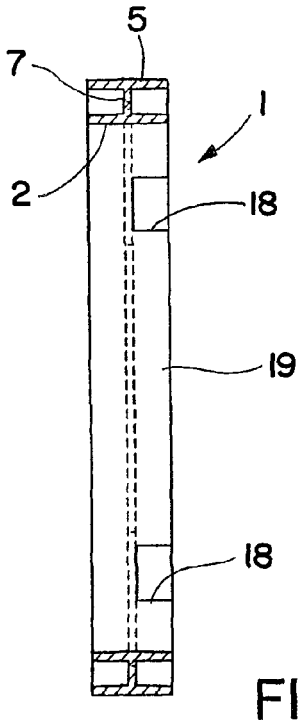
FIG. 2 is a transverse section through the packing bracket of FIG. 1, taken along the plane of the line 2-2 thereof.
Figure 3:
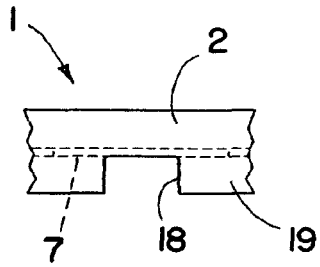
FIG. 3 is an enlarged schematic side view of one of several slots in one end of the ring portion of the packing bracket of FIG. 1 as seen from the plane of the line 3-3 thereof.

Both the ring portion 2 and surrounding frame portion 5 of the packing bracket are desirably of substantially the same length, which may vary, for example, between approximately 1 inch and approximately 1¼ inch, depending on the size of the column to be supported thereby inside a carton. Also the webbing 7 is desirably at the approximate center of the length of the ring portion 2 and surrounding frame portion 5 as schematically shown in FIG. 2. Moreover, both the ring portion 2 and surrounding frame portion 5 as well as the webbing 7 may each have a wall thickness of between approximately ⅙ inch and approximately ⅛ inch.

Figure 4:
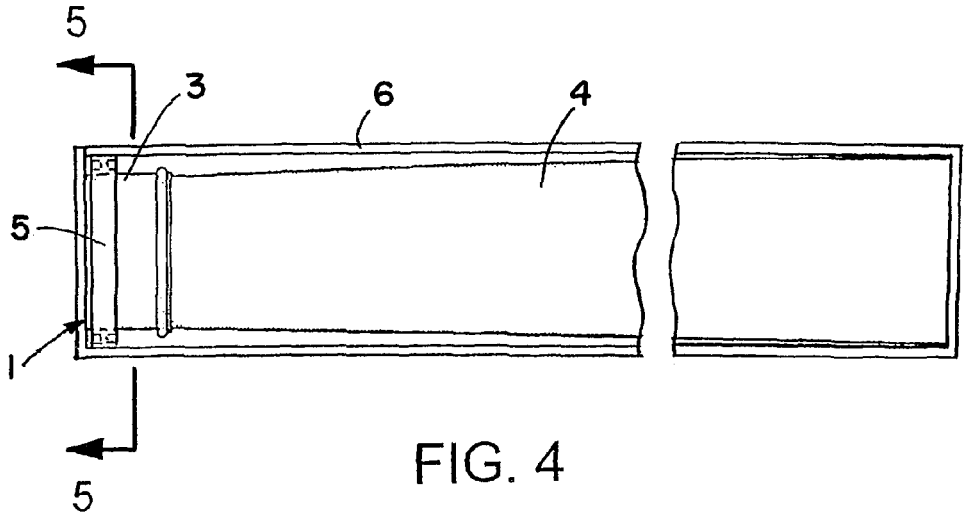
FIG. 4 is a schematic longitudinal section through a cardboard shipping carton containing a tapered architectural column having its smaller end supported within the carton by the packing bracket of FIGS. 1 and 2.
Figure 6:
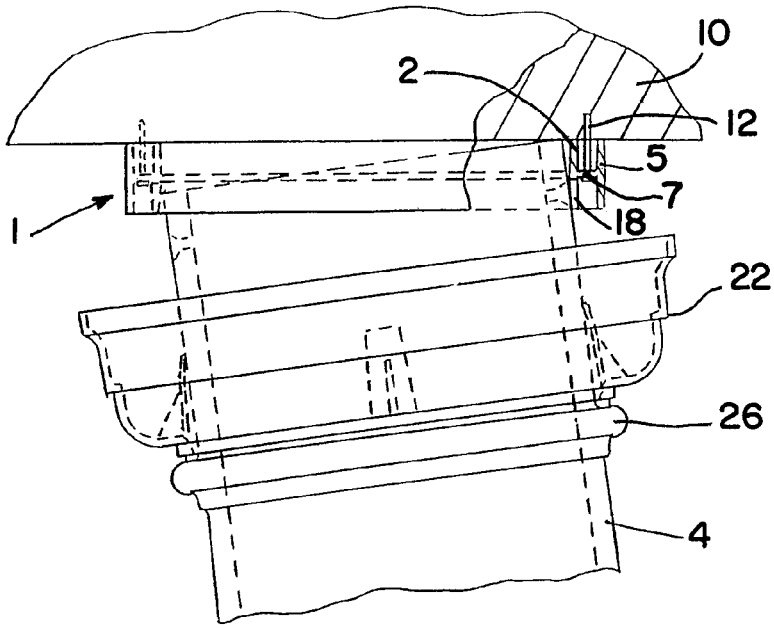
FIG. 6 is a schematic fragmentary side view, partly in section, showing the packing bracket of FIGS. 1 and 2 attached to a ceiling or roof support structure and the smaller top end of a tapered column inserted at an angle partway into the ring portion of the packing bracket after an ornamental capital has been slid down over the top end for locating the top end relative to the support structure.
Figure 7:
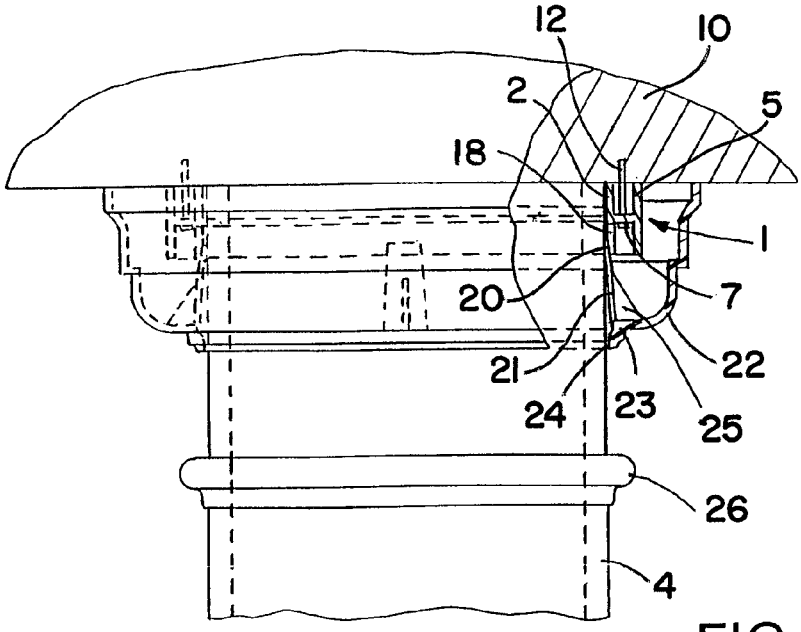
FIG. 7 is an enlarged schematic fragmentary side view, partly in section, similar to FIG. 6 but showing the column extending substantially perpendicular to the support structure with the bottom end of the column in vertical alignment with the top end and the capital raised up substantially flush with the bottom of the support structure.
Figure 8:
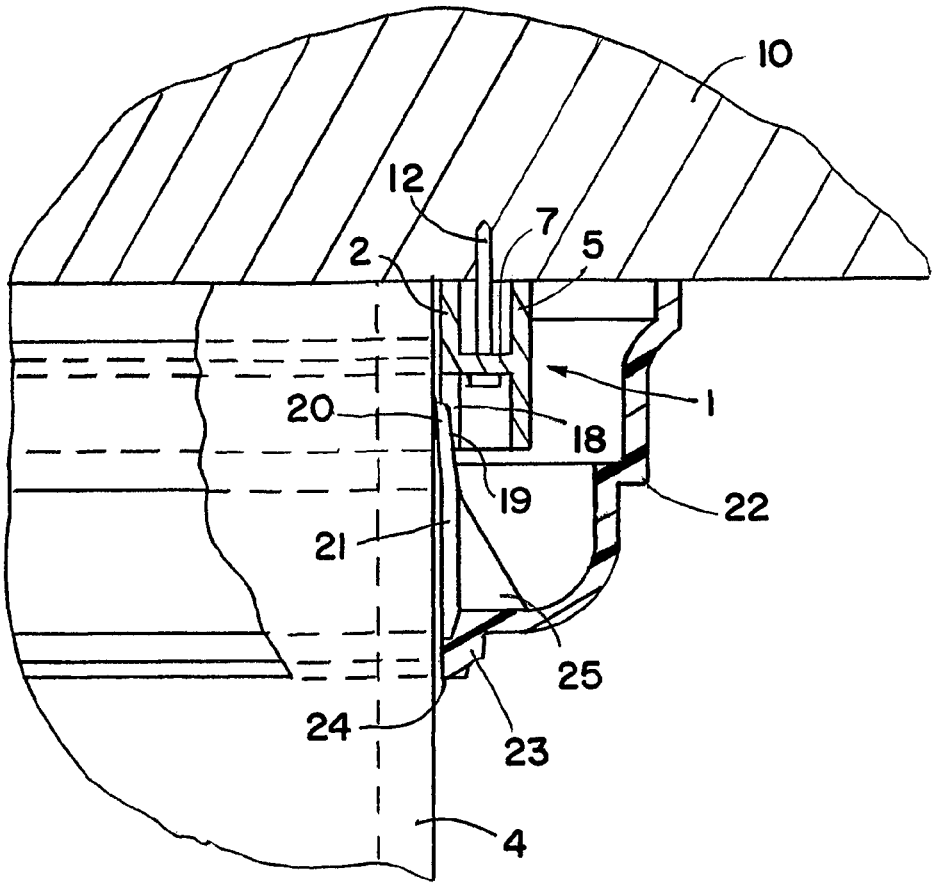
FIG. 8 is a further enlarged schematic fragmentary side view, partly in section, of a portion of the assembly of FIG. 7.

FIGS. 4 and 5 show the smaller top end 3 of a tapered column 4 supported by the packing bracket 1 of the present invention within a shipping carton 6. After the carton has been opened and the column has been removed therefrom, the packing bracket may be used to locate the smaller top end of the column in place wherever desired along a ceiling or roof support structure 10 during installation of the column by attaching the packing bracket to the support structure using two or more suitable fasteners 12 such as drywall screws. To facilitate such attachment, a plurality of circumferentially spaced mounting holes 16 are desirably formed in the webbing 7 during molding of the packing bracket. FIGS. 1 and 5 show two such mounting holes 16 in the webbing along each side of the frame portion 5 off center relative to the corners 17 of the frame portion. This leaves room at the corners for molding two or more slots 18 in the end 19 of the ring portion 2 that faces downwardly when the packing bracket is attached to the support structure 10 as schematically shown in FIGS. 6-8. Four such slots 18 are shown substantially centered with respect to each of the corners of the frame portion in FIGS. 1-3. The purpose of such slots 18, if provided, is to accommodate the upper ends 20 of spring tabs 21 if used to frictionally secure an ornamental capital 22 to the exterior wall surface of the column 4 after the capital has been placed over the top end of the column and raised upwardly substantially to cover the packing bracket as schematically shown in FIGS. 7 and 8. Such spring tabs 21, if provided, may, for example, be of the type disclosed in U.S. patent application Ser. No. 12/388,629, the entire disclosure of which is incorporated herein by reference. More particularly, where the body member 23 of the capitals 22 is molded out of a suitable thermoplastic material with relatively thick (e.g., rigid) walls, the spring tabs 21 may be integrally molded with the body member around an opening 24 in the lower end of the body member sized to closely receive the smaller top end of the column as schematically shown in FIGS. 7 and 8.

The lower end portions of the spring tabs may be supported against outward flexing by angled reinforcing webs 25 integral with the back side of the tabs and body member around the opening. The upper end portions 20 of the spring tabs 21 frictionally engage the exterior wall surface of the smaller end of the column as shown in FIGS. 6-8.

Once the packing bracket has been suitably attached to the ceiling or roof support structure 10 at the desired location and orientation, the support structure needs to be raised sufficiently to allow the smaller top end of the column to be inserted into the ring portion 2 of the packing bracket at an angle after the ornamental capital 22 has been slid down over the smaller top end as schematically shown in FIG. 6 and a base (not shown) has been placed over the larger end of the column. Because the packing bracket 1 preferably has a length of no more than approximately 1 inch to approximately 1¼ inch, and the ring portion 2 preferably has approximately a 1/16 inch clearance C around the smaller top end of the column, it is relatively easy to insert the smaller top end of the column into the ring opening 8 at an angle without having to raise the support structure 10 very much. Also the clearance space C between the ring portion 2 and smaller top end of the column makes it easier to position or move the larger bottom end of the column into vertical alignment with the smaller top end of the column once the top end has been inserted into the ring opening.

After the column has been set in place under the support structure 10 and the support structure has been lowered onto the top end of the column, the capital 22 may be raised upwardly substantially to cover the packing bracket 1 as schematically shown in FIGS. 7 and 8. If the capital is provided with a plurality of circumferentially spaced spring tabs 21 to frictionally retain the capital on the column, the slots 18 in the ring portion 2 will accommodate the upper ends of the spring tabs during raising of the capital upwardly as further shown in FIGS. 7 and 8.

Using this mounting method for mounting the smaller top end of a tapered column to a support structure is much easier than using conventional L brackets because there is only about 1½ inches of clearance between the L brackets and the top of the capital to work in when the capital is resting on top of the column neck ring 26 as schematically shown in FIG. 6. Although the L brackets can be attached to the column using nuts and bolts before positioning the column in place, the L brackets can't be attached to the support structure until after the column is in place, which does not leave very much room to work in. Also, while it is known to attach a square wood block to the support structure to locate the upper end of the column over the block, it is still necessary to attach the column to the block through predrilled holes in the sides of the column. Here again, there is only about a 1½ inch gap between the top of the capital and the support structure when the capital is resting on the column neck ring, which doesn't provide much room to attach the upper end of the column to the block. Also the screw holes in the upper end of the column need to be angled to provide enough room to be able to insert a screwdriver between the support structure and top of the capital because the wooden block can't be very thick or the support structure would have to be jacked up too high to be able to insert the column over the block. In the usual case, the block is no thicker than a 2×4.

Alternatively, instead of using just one packing bracket 1 to support the smaller top end 3 of a tapered architectural column inside a shipping carton in the manner previously described, two packing brackets may be used for supporting both the smaller top and larger bottom ends of the tapered architectural column during shipment and storage. This eliminates the need for having to place the columns in shipping cartons during shipment and storage and allows the columns to be stacked with the packing brackets placed on top of one another to form a plurality of individual stacks that may be palletized. Also the columns may be shrink wrapped during storage and shipment, which allows the columns to be easily inspected, thereby virtually eliminating concealed damage claims. Moreover, one or both of the packing brackets may subsequently be used for locating one or both ends of the columns in place during installation as described hereafter.

Figure 9:
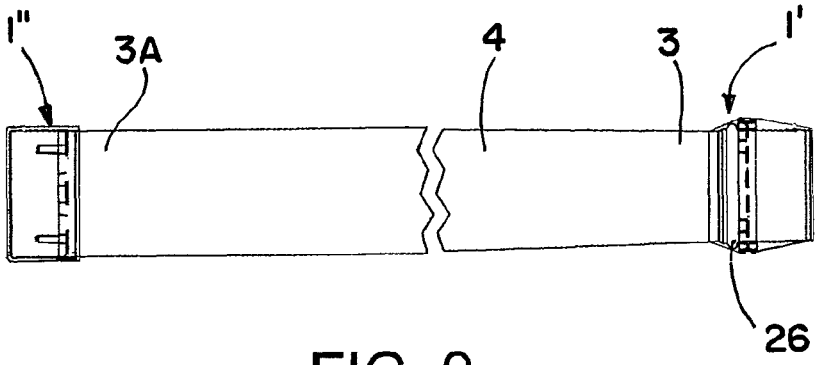
FIG. 9 is a schematic fragmentary side view of a tapered architectural column having both ends supported by respective top and bottom packing brackets of the present invention.
Figure 12:
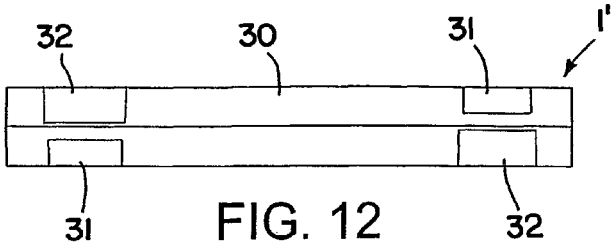
FIG. 12 is a top plan view of the top packing bracket of FIG. 10.
Figure 10:
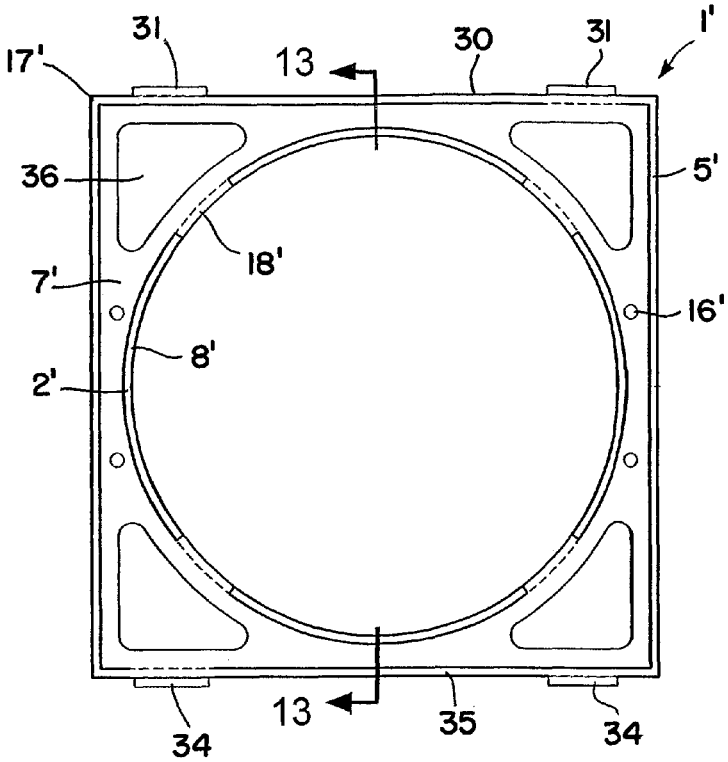
FIG. 10 is an enlarged schematic end view of the top packing bracket of FIG. 9.
Figure 13:
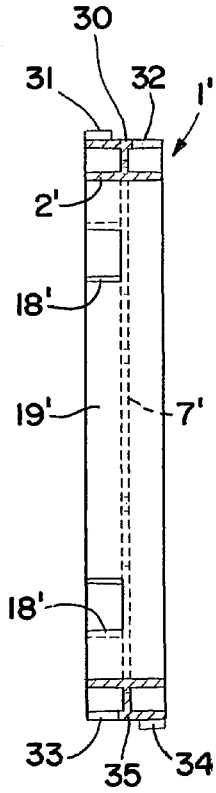
FIG. 13 is a vertical section through the top packing bracket of FIG. 10, taken on the plane of the line 13-13 thereof.
Figure 11:
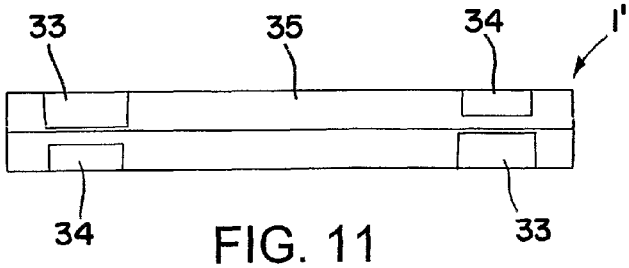
FIG. 11 is a bottom plan view of the top packing bracket of FIG. 10.
Figure 14:
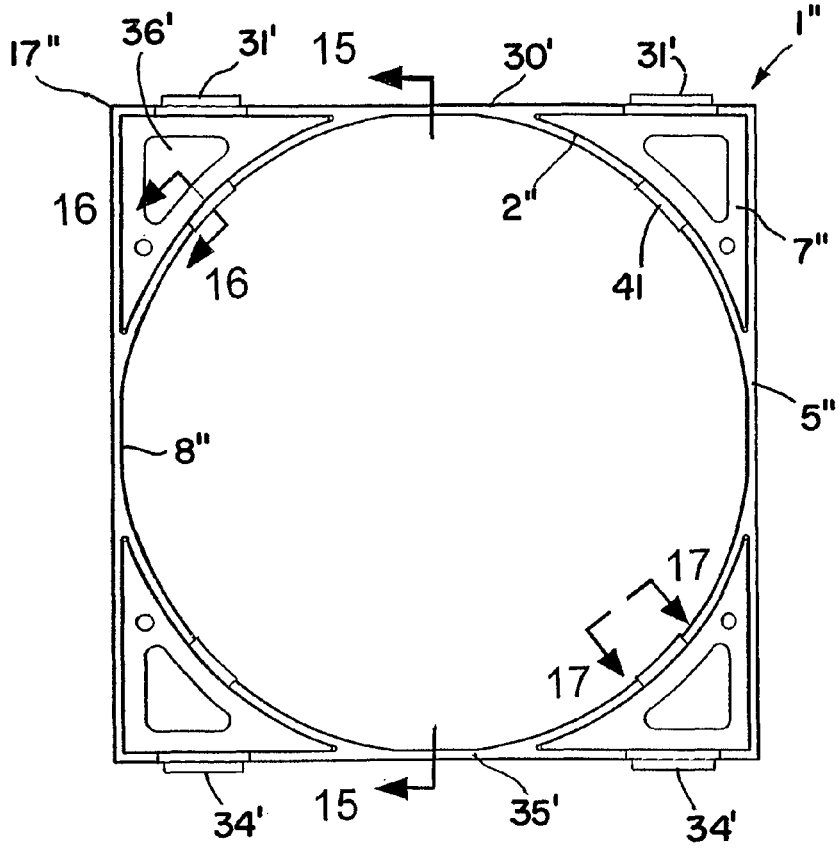
FIG. 14 is an enlarged schematic end view of the bottom packing bracket of FIG. 9.
Figure 15:
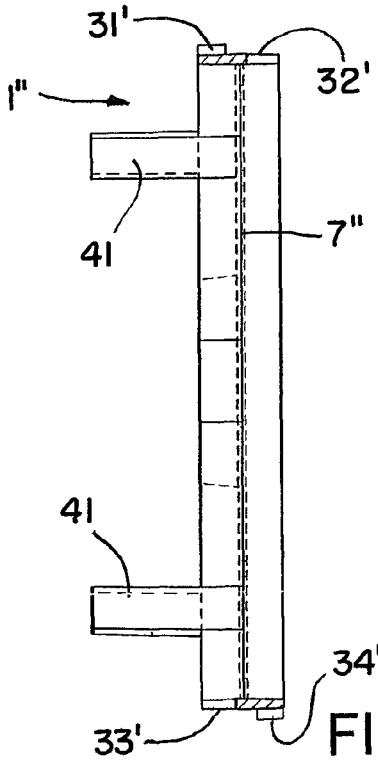
FIG. 15 is a vertical section through the bottom packing bracket of FIG. 14, taken on the plane of the line 15-15 thereof.
Figure 16:
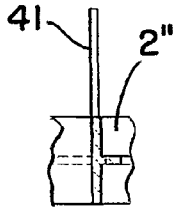
FIG. 16 is a fragmentary transverse section through the ring portion and one of several axially protruding fingers of the bottom packing bracket of FIG. 14, taken on the plane of the line 16-16 thereof.
Figure 17:
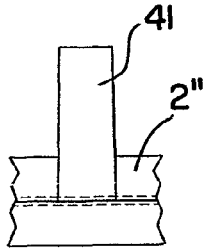
FIG. 17 is a side view of one of the fingers and a portion of the ring of the bottom packing bracket of FIG. 14 as seen from the plane of the line 17-17 thereof.
Figure 18:
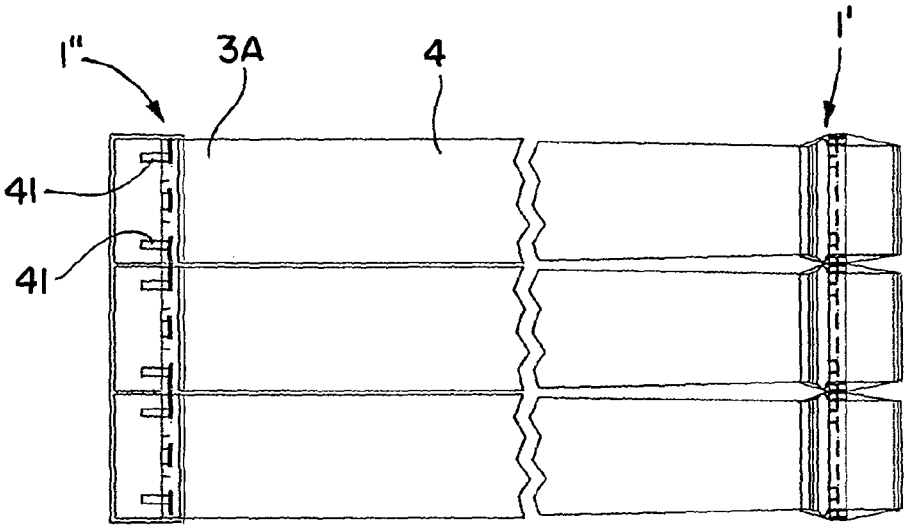
FIG. 18 is a schematic fragmentary side view of a plurality of tapered columns shown stacked on top of one another with the respective top and bottom packing brackets of FIG. 9 interlocked to prevent both side to side and front to back movement of the packing brackets and columns relative to one another.
Figure 20:
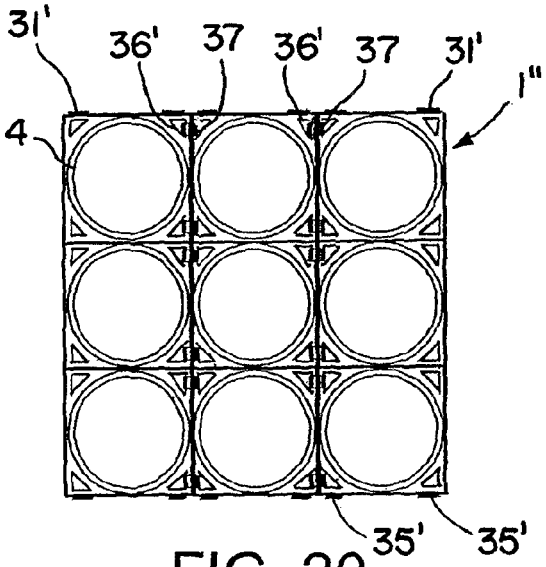
FIG. 20 is a schematic end elevation view of the larger bottom ends of the individual stacks of side by side columns of FIG. 19.
Figure 19:
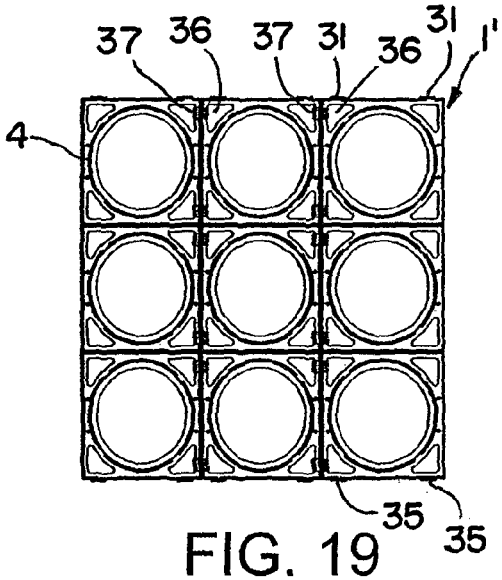
FIG. 19 is a schematic end view of the smaller top ends of a plurality of individual stacks of columns of FIG. 18 held together in side by side relation to one another for palletizing.
Figure 21:
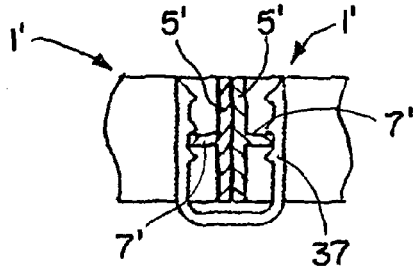
FIG. 21 is an enlarged fragmentary section through the frame portions of two of the top packing brackets surrounding two adjacent individual stacks of columns of FIG. 19 showing a U shaped clip extending around portions of both frame portions to hold the individual stacks together.
Figure 22:
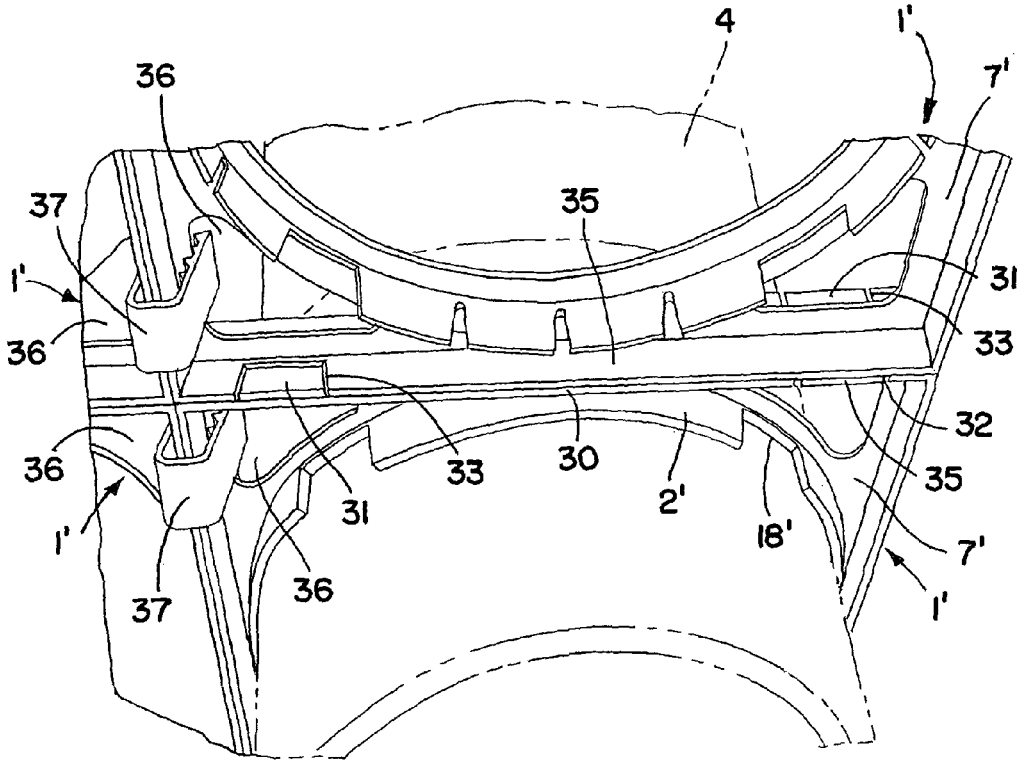
FIG. 22 is an enlarged fragmentary perspective view of contacting top packing brackets surrounding two adjacent individual stacks of columns of FIG. 9 stacked on top of one another.

FIG. 9 shows one such tapered column 4 supported at opposite ends 3 and 3A by respective packing brackets 1' and 1" both of which may be similar in construction to packing bracket 1 previously described. Accordingly, the same reference numerals followed by prime and double prime symbols are used to designate like parts. The principal difference between the packing brackets 1', 1" shown in FIG. 9 (and in greater detail in FIGS. 10-17) and the packing bracket 1 previously described is that one side 30, 30' of the frame portion 5', 5" of each of the packing brackets 1', 1" desirably has at least two laterally spaced axially offset tabs 31, 31' and slots 32, 32' in alignment with respective slots 33, 33' and tabs 34, 34' in the opposite side 35, 35'. This allows for engagement of the tabs 31, 31' on one of the sides of the respective packing brackets with respective slots 33, 33' in the other side of other respective packing brackets and the tabs 34, 34' on the other side in the respective slots 32, 32' in the one side when the respective packing brackets are placed around respective ends of two or more columns and the packing brackets are stacked on top of each other as shown in FIGS. 18-20 for interlocking the packing brackets (and thus the respective columns) against both side to side and front to back movement relative to one another. Also the webbing 7', 7" between the ring portion 2', 2" and surrounding frame portion 5', 5" of each of the packing brackets 1', 1" has openings 36, 36' therethrough adjacent the corners 17', 17" for insertion of U-shaped clips 37 through the openings of adjacent packing brackets to hold individual stacks of tapered columns together as shown in FIGS. 19-22 for palletizing the columns.

The ring portion 2' of packing bracket 1' is sized to closely receive the smaller top end 3 of the tapered column 4 and may be accurately located thereon by sliding the ring portion down against the neck ring 26 of the column as schematically shown in FIG. 9. Once in place, the packing bracket may be held in place as by wrapping stretch wrap around the packing bracket and column.

The ring portion 2" of the other packing bracket 1" is sized to closely receive the larger bottom end 3A of the tapered column 4, and may have a plurality of circumferentially spaced fingers 41 extending axially therefrom as shown in FIGS. 14-17. Once the packing bracket 1" is slid over the larger bottom end of the tapered column and accurately positioned along the length thereof, the packing bracket may be held in place on the column as by wrapping stretch wrap around the fingers 41 and column as schematically shown in FIGS. 9 and 18. Also the entire column may be shrink wrapped before or after the two packing brackets are secured in place around the respective ends of the column.

Doing away with the shipping carton altogether by using two packing brackets and shrink wrap is much more cost effective and also virtually ends concealed damage claims, since the columns are readily visible through the stretch wrap during shipment and storage.

Figure 23:
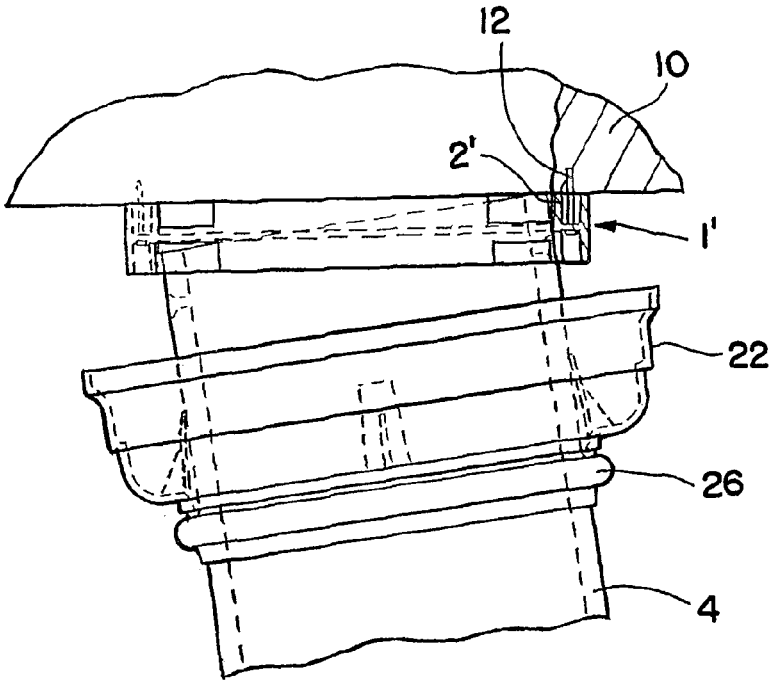
FIG. 23 is a schematic side view, partly in section, showing the top packing bracket of FIGS. 9 and 10 attached to a ceiling or roof support structure with the smaller top end of a tapered column inserted at an angle partway into the ring portion of the top packing bracket after an ornamental capital has been slid down over the top end of the column for locating the top end relative to the support structure and a base and the bottom packing bracket of FIGS. 9 and 14 slid up over the larger bottom end of the column.
Figure 23:
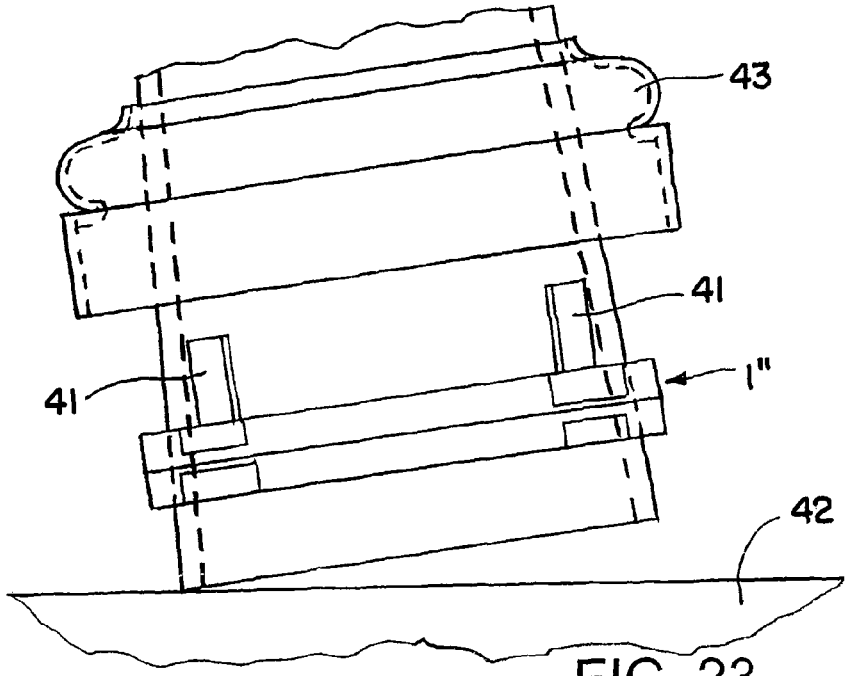
Figure 24:
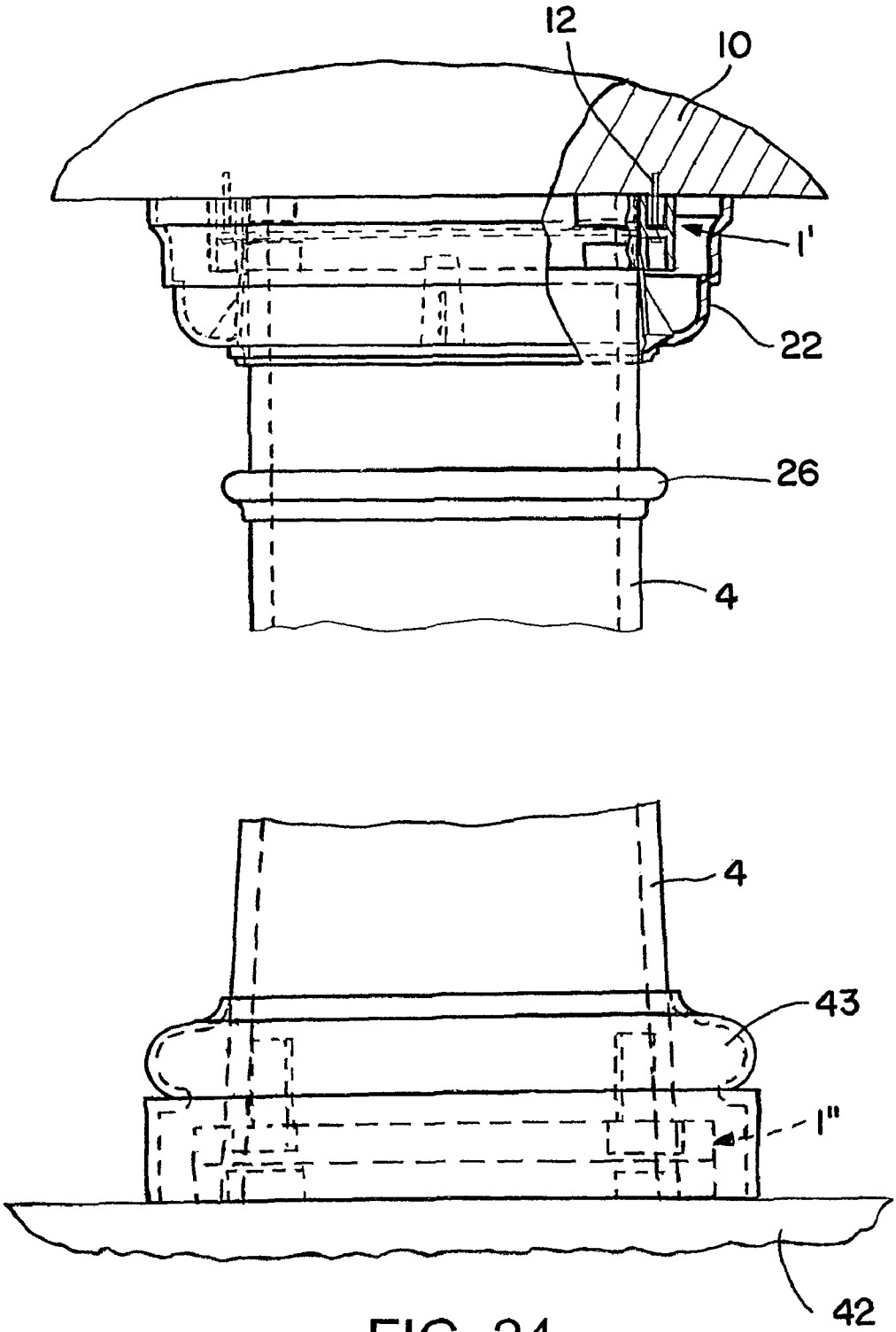
FIG. 24 is an enlarged schematic side view, partly in section, similar to FIG. 23 but showing the column extending substantially perpendicular to the support structure with the capital raised up substantially to cover the top packing bracket and the base member moved down substantially to cover the bottom packing bracket.

After the stretch wrap and packing brackets 1', 1" have been removed from the column, the top packing bracket 1' used to support the smaller top end of the column during shipment and storage may be used to locate the smaller top end of the column in place wherever desired along the ceiling or roof support structure 10 during installation of the column as shown in FIGS. 23 and 24 in the same manner as the packing bracket 1 previously described.

Also, if desired, the bottom packing bracket 1" used to support the larger bottom end of the tapered column during shipment and storage may be used to secure the larger bottom end of the column to a floor support structure 42 by first sliding a base 43 and then the bottom packing bracket 1" over the larger bottom end of the column before the smaller top end of the column is angled into the top packing bracket 1' when attached to the ceiling or roof support structure as schematically shown in FIG. 23. Thereafter the larger bottom end of the column may be moved into vertical alignment with the smaller top end of the column and the bottom packing bracket 1" may be suitably attached to the floor support structure 42 at the desired location after the ceiling or roof support structure has been lowered onto the upper end of the column. Finally the capital 22 may be raised upwardly substantially to cover the top packing bracket 1" and the base 43 may be lowered substantially to cover the bottom packing bracket 1" as schematically shown in FIG. 24.

Although the invention has been shown and described with respect to certain embodiments, it is obvious that equivalent alterations and modifications will occur to other skilled in the art upon the reading and understanding of the specification. In particular, with regard to various functions performed by the above-described components, the terms (including any reference to a "means") used to describe such components are intended to correspond, unless otherwise indicated, to any component which performs the specified function of the described component (e.g., that is functionally equivalent) even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A method of supporting a plurality of tapered architectural columns in stacked relation to one another utilizing top and bottom packing brackets each having a ring portion and a substantially rectangular shaped frame portion surrounding the ring portion, the ring portion and surrounding frame portion being joined together by webbing extending therebetween, the ring portions of the top and bottom packing brackets being sized to closely receive respective smaller top and larger bottom ends of the columns, comprising the steps of inserting the ring portions of the top and bottom packing brackets over the respective smaller top and larger bottom ends of the columns, and stacking the columns on top of one another with the respective top and bottom packing brackets in interlocking engagement with each other to prevent both side to side and front to back movement of the packing brackets and associated columns with respect to one another, wherein one side of the frame portion of each of the packing brackets has at least two laterally spaced axially offset tabs and slots in alignment with respective slots and tabs in an opposite side of the frame portion for engagement of the tabs on one of the sides with respective slots in the other side and the tabs on the other side in the respective slots in the one side of the packing brackets when the packing brackets are placed around respective ends of two or more of the columns and the packing brackets are stacked on top of each other for interlocking the packing brackets against both side to side and front to back movement relative to one another, placing two or more individual stacks of the columns in side by side relation to one another, and inserting substantially U-shaped clips through openings in the web portions of adjacent packing brackets of the individual stacks of columns to hold the individual stacks of columns together for palletizing.

2. A method of supporting a plurality of tapered architectural columns in stacked relation to one another utilizing top and bottom packing brackets each having a ring portion and a substantially rectangular shaped frame portion surrounding the ring portion, the ring portion and surrounding frame portion being joined together by webbing extending therebetween, the ring portions of the top and bottom packing brackets being sized to closely receive respective smaller top and larger bottom ends of the columns, comprising the steps of inserting the ring portions of the top and bottom packing brackets over the respective smaller top and larger bottom ends of the columns, and stacking the columns on top of one another with the respective top and bottom packing brackets in interlocking engagement with each other to prevent both side to side and front to back movement of the packing brackets and associated columns with respect to one another, wherein each of the columns has a neck ring in spaced relation from the smaller top end of each of the columns, and the top packing bracket is slid up against the neck ring for locating the top packing bracket on associated columns and held in place on the columns by stretch wrap.

3. A method of supporting a plurality of tapered architectural columns in stacked relation to one another utilizing top and bottom packing brackets each having a ring portion and a substantially rectangular shaped frame portion surrounding the ring portion, the ring portion and surrounding frame portion being joined together by webbing extending therebetween, the ring portions of the top and bottom packing brackets being sized to closely receive respective smaller top and larger bottom ends of the columns, comprising the steps of inserting the ring portions of the top and bottom packing brackets over the respective smaller top and larger bottom ends of the columns, and stacking the columns on top of one another with the respective top and bottom packing brackets in interlocking engagement with each other to prevent both side to side and front to back movement of the packing brackets and associated columns with respect to one another, wherein the ring portion of the bottom packing bracket has a plurality of circumferentially spaced axially extending fingers about which stretch wrap is wound to hold the bottom packing bracket in place on associated columns.

4. A method of supporting a plurality of tapered architectural columns in stacked relation to one another utilizing top and bottom packing brackets each having a ring portion and a substantially rectangular shaped frame portion surrounding the ring portion, the ring portion and surrounding frame portion being joined together by webbing extending therebetween, the ring portions of the top and bottom packing brackets being sized to closely receive respective smaller top and larger bottom ends of the columns, comprising the steps of inserting the ring portions of the top and bottom packing brackets over the respective smaller top and larger bottom ends of the columns, and stacking the columns on top of one another with the respective top and bottom packing brackets in interlocking engagement with each other to prevent both side to side and front to back movement of the packing brackets and associated columns with respect to one another, wherein the top packing bracket that is used to support the smaller top end of associated columns during shipment and storage is also used to locate the smaller top end of the columns along a ceiling or roof support structure after the packing brackets have been removed from the columns by attaching the top packing bracket at a desired location and orientation to the ceiling or roof support structure, raising the ceiling or roof support structure sufficiently to allow the smaller top end of the columns to be inserted into the ring portion of the top packing bracket at an angle after an ornamental capital has been slid down over the smaller top end of the column, moving the larger bottom end of the column into vertical alignment with the smaller top end, and lowering the ceiling or roof support structure into engagement with the smaller top end of the column.

5. The method of claim 4 wherein the bottom mounting bracket that is used to support the larger bottom end of the column during shipment and storage is also used to secure the larger bottom end of the column to a floor support structure after the packing brackets have been removed from the column by sliding a base and then the bottom packing bracket over the larger bottom end of the column before the smaller top end of the column is angled into the top packing bracket when attached to the ceiling or roof support structure, and after the larger bottom end of the column has been moved into vertical alignment with the smaller top end of the column, the bottom packing bracket is attached to the floor support structure.

6. The method of claim 5 wherein after the ceiling or roof support structure has been lowered onto the smaller top end of the column and the bottom packing bracket has been attached to the floor support structure, the capital is raised upwardly substantially to cover the top packing bracket and the base is lowered substantially to cover the bottom packing bracket.

7. A method of locating a smaller top end of a tapered architectural column along a ceiling or roof support structure using a packing bracket that is also used to support the smaller top end of the column inside a carton during shipment and storage, the packing bracket including a ring portion sized to closely receive the smaller top end of the column, and a frame portion surrounding the ring portion sized to closely fit inside the carton, the method comprising the steps of attaching the packing bracket at a desired location and orientation to the ceiling or roof support structure, raising the ceiling or roof support structure sufficiently to allow the smaller top end of the column to be inserted into the ring portion at an angle after an ornamental capital has been slid down over the smaller top end of the column, moving a larger bottom end of the column into vertical alignment with the smaller top end, and lowering the ceiling or roof support structure into engagement with the smaller top end of the column.

8. The method of claim 7 wherein the ring portion and surrounding frame portion are joined together by webbing extending therebetween, further comprising the step of inserting fasteners through one or more mounting holes in the webbing for securing the packing bracket to the support structure.

9. A method of supporting a smaller top end of a tapered architectural column inside a carton during shipment and storage using a packing bracket that is also used to locate the smaller top end of the column along a ceiling or support structure after the column and packing bracket have been removed from the carton, the carton having substantially the same rectangular cross-sectional size and shape throughout its length and sized for closely receiving a larger bottom end of the column inside the carton, and the packing bracket including a ring portion sized to closely receive the smaller top end of the column, and a frame portion surrounding the ring portion sized to closely fit inside the carton, the method comprising inserting the smaller top end of the column through the ring portion of the packing bracket, placing the larger bottom end of the column and the packing bracket containing the smaller top end of the column inside the carton to support the column inside the carton during shipment and storage, removing the column and packing bracket from the carton, removing the packing bracket from the smaller top end of the column, attaching the packing bracket at a desired location and orientation to the ceiling or roof support structure, raising the ceiling or roof support structure sufficiently to allow the smaller top end of the column to be inserted into the ring portion at an angle after an ornamental capital has been slid down over the smaller top end of the column, moving the larger bottom end of the column into vertical alignment with the smaller top end, and lowering the ceiling or roof support structure into engagement with the smaller top end of the column.

10. The method of claim 9, wherein the ring portion and surrounding frame portion of the packing bracket are joined together by webbing extending therebetween, further comprising the step of inserting fasteners through one or more mounting holes in the webbing for securing the packing bracket to the support structure.

11. Top and bottom packing brackets for supporting respective smaller top and larger bottom ends of tapered architectural columns during shipment and storage, each of the packing brackets comprising a ring portion and a frame portion surrounding the ring portion, the ring portion and surrounding frame portion being joined together by webbing extending therebetween, the ring portions of the top and bottom packing brackets being sized to closely receive the respective smaller and larger top and bottom ends of the columns, wherein the ring portion of the bottom packing bracket has a plurality of circumferentially spaced axially extending fingers about which stretch wrap is wound to hold the bottom packing bracket in place on associated columns.

12. An assembly comprising a tapered architectural column contained inside a shipping carton for shipment and storage, the column having respective smaller top and larger bottom ends, and the carton having substantially the same rectangular cross-sectional size and shape throughout its length and sized such that the larger bottom end of the column is closely received inside the carton, and the smaller top end of the column is supported inside the carton by a packing bracket, the packing bracket comprising a ring portion and a frame portion surrounding the ring portion, wherein the ring portion and the frame portion are integrally joined together by webbing extending therebetween, the ring portion closely receives the smaller top end of the column, and the frame portion is closely received inside the carton, and wherein the smaller top end of the column extends completely through and beyond the ring portion of the packing bracket inside the carton.

13. An assembly comprising a tapered architectural column contained inside a shipping carton for shipment and storage, the column having respective smaller top and larger bottom ends, and the carton having substantially the same rectangular cross-sectional size and shape throughout its length and sized such that the larger bottom end of the column is closely received inside the carton, and the smaller top end of the column is supported inside the carton by a packing bracket, the packing bracket comprising a ring portion and a frame portion surrounding the ring portion, wherein the ring portion and the frame portion are integrally joined together by webbing extending therebetween, the ring portion closely receives the smaller top end of the column, and the frame portion is closely received inside the carton, and wherein the packing bracket is a dual function bracket that locates the smaller top end of the column in place along a ceiling or a roof structure after the column and the packing bracket have been removed from the carton, the webbing of the packing bracket having a plurality of circumferentially spaced mounting holes extending through the webbing that receive fasteners for securing the packing bracket at any desired location along the ceiling or roof support structure.

14. The assembly of claim 13 wherein the frame portion of the packing bracket is substantially square shaped with four corners and the mounting holes are off center relative to the corners.

15. The assembly of claim 14 wherein there are a plurality of slots in one end of the ring portion in circumferentially spaced relation from each other and from the mounting holes.

16. An assembly comprising a plurality of tapered architectural columns having respective smaller top and larger bottom ends, and associated top and bottom packing brackets independently supporting the respective smaller top and larger bottom ends of the respective columns during shipment and storage, each of the packing brackets comprising a ring portion and a frame portion surrounding the ring portion, the ring portion and supporting frame portion being integrally joined together by webbing extending therebetween, the ring portions of the respective top and bottom packing brackets being sized for close receipt of the respective smaller top and larger bottom ends of the respective columns, wherein one side of the frame portion of each of the packing brackets has at least two laterally spaced axially offset tabs and slots in alignment with respective slots and tabs in an opposite side of the frame portion in which the tabs on one of the sides engage with the respective slots in the other side of one or more other packing brackets and the tabs on the other side engage with the respective slots in the one side with the respective packing brackets stacked on top of each other to interlock the packing brackets against both side to side and front to back movement relative to one another, and wherein the frame portion of each of the packing brackets is substantially square shaped with four corners, and the webbing of each of the packing brackets has openings therethrough adjacent the corners, and substantially U-shaped clips are inserted through the openings of adjacent packing brackets to hold individual stacks of columns together for palletizing.

17. An assembly comprising a tapered architectural column having respective smaller top and larger bottom ends, and top and bottom packing brackets supporting the respective smaller top and larger bottom ends of the column during shipment and storage, each of the packing brackets comprising a ring portion and a frame portion surrounding the ring portion, the ring portion and supporting frame portion being integrally joined together by webbing extending therebetween, the ring portions of the respective top and bottom packing brackets being sized for close receipt of the respective smaller top and larger bottom ends of the column, wherein the column is shrink wrapped, which allows the column to be easily inspected for damage during shipment and storage.

* * * * *